United States Patent [19]

Romanowski

[11] 4,433,837

[45] Feb. 28, 1984

[54] SHEET SORTER APPARATUS

[75] Inventor: Robert F. Romanowski, Rochester, N.Y.

[73] Assignee: Salvatore Latone, Rochester, N.Y.

[21] Appl. No.: 226,997

[22] Filed: Jan. 21, 1981

[51] Int. Cl.[3] ..... B65H 39/11

[52] U.S. Cl. ..... 271/293; 271/294

[58] Field of Search ..... 271/294, 293, 292, 295, 271/288, 287, 279; 270/58

[56] References Cited

U.S. PATENT DOCUMENTS

| | | | |
|---|---|---|---|
| 1,373,700 | 4/1921 | Avery . | |
| 1,432,890 | 10/1922 | Neely . | |
| 1,579,469 | 4/1926 | Cooper . | |
| 2,449,594 | 9/1948 | Druliner . | |
| 2,589,676 | 3/1952 | Crissy . | |
| 3,721,435 | 3/1973 | Zanders | 271/294 X |
| 4,087,087 | 5/1978 | Looney | 271/293 X |
| 4,116,427 | 9/1978 | Muller . | |
| 4,203,587 | 5/1980 | Kishi et al. | 271/293 |
| 4,253,656 | 3/1981 | Landa | 271/294 X |
| 4,328,963 | 5/1982 | Dubois et al. | 271/293 |
| 4,332,377 | 6/1982 | Dubois et al. | 271/293 |
| 4,337,936 | 7/1982 | Lawrence | 271/293 |
| 4,343,463 | 8/1982 | Lawrence | 271/293 |

FOREIGN PATENT DOCUMENTS

| | | | |
|---|---|---|---|
| 2066778 | 7/1981 | United Kingdom | 271/294 |

*Primary Examiner*—Bruce H. Stoner, Jr.
*Attorney, Agent, or Firm*—Martin Lukacher

[57] ABSTRACT

Multiple copies of sheets produced by a duplicator, xerographic copier or the like are sorted onto trays. The trays are arranged in a stack and are moved upwardly and downwardly to enable different sheets to be sorted onto the trays on each upward pass and downward pass of the stack. A carriage retains the stack and moves upwardly and downwardly with the stack as individual trays are engaged and translated around a region where adjacent trays are spread apart to register the trays successively at a position where individual sheets are received thereon. Bidirectional movement of the entire stack of trays with a mechanism which raises or lowers a single tray provides a sorter of compact size which is simple, reliable and low in cost and which operates without generating excessive noise.

20 Claims, 10 Drawing Figures

SHEET SORTER APPARATUS

DESCRIPTION

BACKGROUND AND SUMMARY

The present invention relates to sheet sorter apparatus and particularly to a machine for sorting sheets produced by a duplicator, such as a xerographic copier, and arranging or collating such sheets into sets.

Sorter apparatus embodying the invention is especially suitable for use with compact xerographic copiers in order to sort the number of duplicate copies of the same sheet which such copiers are designed to produce, for example, up to approximately ten or twenty sheets. Other applications for the invention may be found wherever automatic sorting and collating of sets of sheets is desired.

Sorters have generally been large and complex machines. Because of their size they have not been adapted for use with small, so-called desk top xerographic copiers. It is desirable to provide sorting facilities for the smaller copiers having the capabilities of the large, complex sorters, but of a size and at a cost which is comparible with the smaller copiers. It has been proposed to use a stack of trays and drop the trays successively out of the stack so that they move through a location aligned with the exit feed rollers of the copier. The bidirectional sorting capability of the larger copiers has not been maintained. For example, the entire stack of trays must be indexed onto starting position before each group of like copies can be sorted. Sorting speeds are lower than is the case for the large sorters. Moreover, drop mechanisms are subject to failure and tend to be noisy.

It is therefore an object of the present invention to provide improved sorter apparatus which is compatible, and adapted for use, with small, desk top type copiers.

It is the further object of the invention to provide improved sorter apparatus which is compact in size and has the capability of distributing a number of sheets into a set, similar to that of larger sorters.

It is a still further object of the present invention to provide improved sorter apparatus utilizing a stack of trays into which sheets are distributed which trays are bidirectionally movable into and out of position to receive sheets from a duplicator, copier or sheet feeding device associated therewith.

It is a still further object of the present invention to provide improved sorter apparatus which does not rely on gravity and is positively moved in the course of sheet distributing operations.

It is still a further object of the present invention to provide improved sorter apparatus in which the generation of noise during operation is minimized.

It is a still further object of the present invention to provide improved sorter apparatus which is simple and reliable and may be implemented at low cost.

Briefly described, sheet sorting apparatus embodying in the invention makes use of a plurality of sheet receiving trays which are disposed in a stack. The trays are retained in stacked relationship by means which are movable therewith. The stack may, for example, be movable in a generally vertical direction upwardly and downwardly. The retaining means for the stack of trays may be located at the sides of the trays near the front end thereof where the sheet feeder, such as the exit feed rolls of the copier associated with the sorting apparatus, is located. The rear ends of the trays can be loosely disposed on the shelves of a rack so as to enable translational and pivotal movement of the rear ends of the trays. Guide means which also may be located along the sides of the trays near the front ends thereof, provide the path along which the trays are moveable. This path includes a region where adjacent ones of the trays are spread apart to receive the sheets. The retaining means is operative to locate and register adjacent trays at opposite ends of the region, and provides a carriage for the stack of trays. In order to move the trays, and the stack of trays, either upwardly or downwardly, means are provided which are engagable with the tray at one end of the sheet receiving region or with the tray at the opposite end of that region to carry the engaged tray between the ends of the region. As the engaged tray moves, the retaining means and the stack of trays together with the engaged tray also move along the path defined by the guide means. The sheet receiving region of the path over which the trays are carried may be semicircular. Each tray may be engaged by an orbiting member driven by a crank mechanism so as to carry it between the opposite ends of the region. The stack is confined in the retaining means, such that when the crank mechanism moves (lifts or lowers) a tray along the sheet receiving region, it transfers forces through the stack to the retaining means so as to enable the retaining means to lift or lower the entire stack. Bidirectional operation is therefore obtained with lifting or lowering operations of the crank mechanism being carried out for each sheet which is fed into the sorting apparatus.

DRAWINGS

The foregoing and other objects features and advantages of the invention will become more apparent from a reading of the following description in connection with the accompanying drawings which illustrate sheet sorting apparatus in accordance with an embodiment of the invention. In the drawings.

Figure 4:
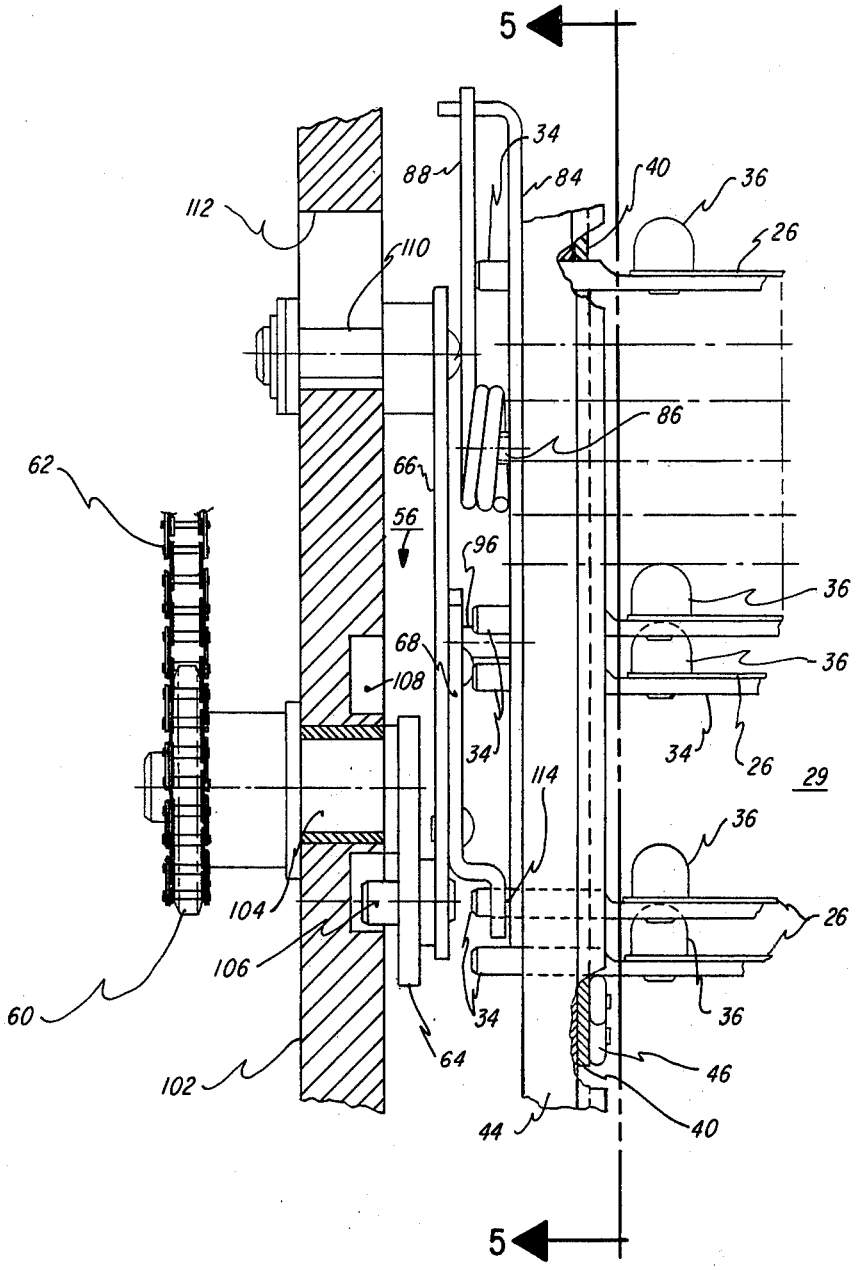
FIG. 4 is a fragmentary view one of the mechanisms which move the trays into and out of sheet receiving position, the view being taken from the front end of the sorter apparatus.
Figure 5:
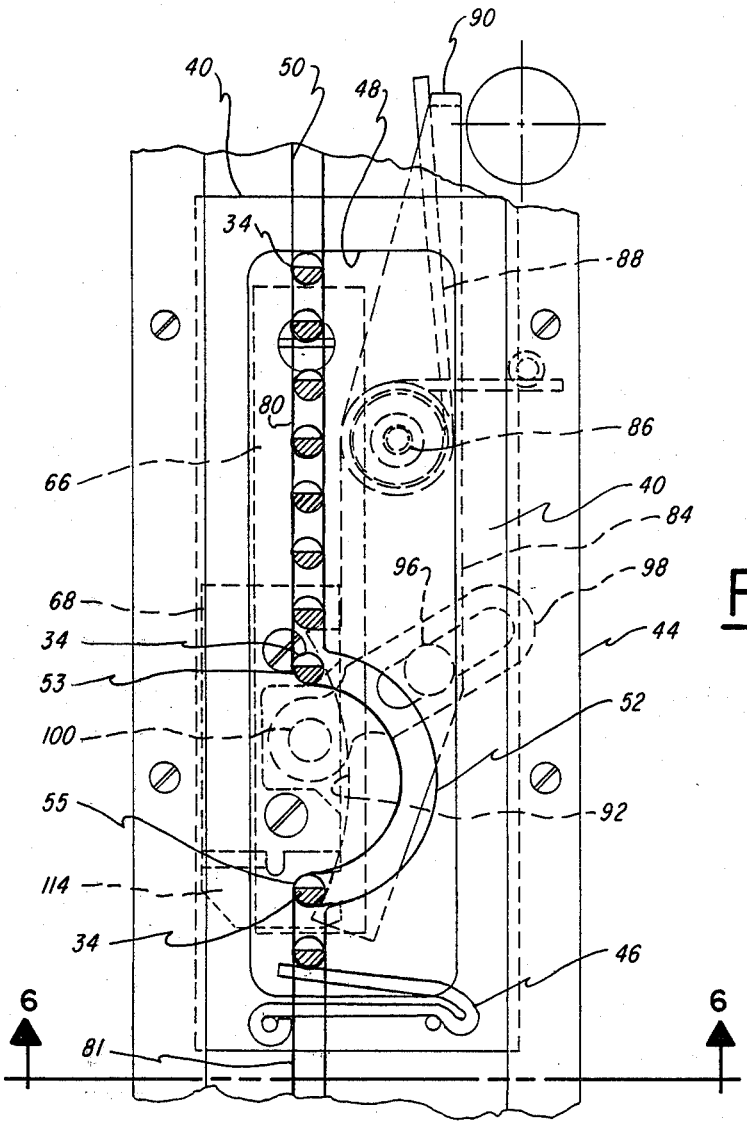
FIG. 5 is a fragmentary, sectional side view of the mechanism shown in FIG. 4, taken along the line 5—5 in FIG. 4.
Figure 6:
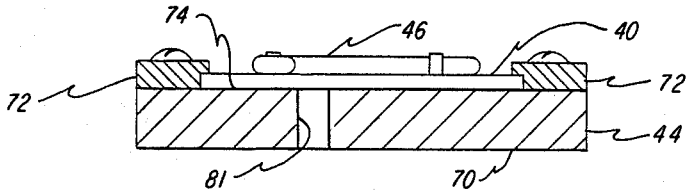
FIG. 6 is a sectional end view of the mechanism shown in FIG. 5 taken along the line 6—6 in FIG. 5.
Figure 7B:
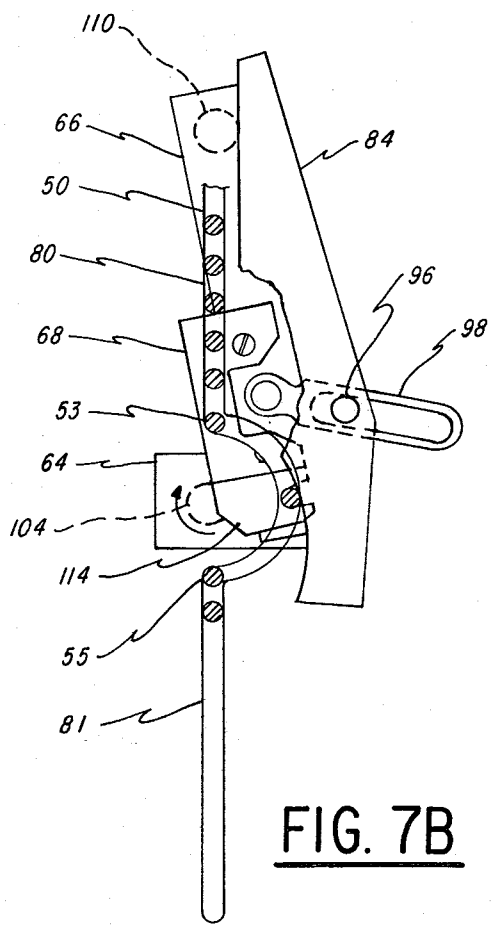
Figure 7A:
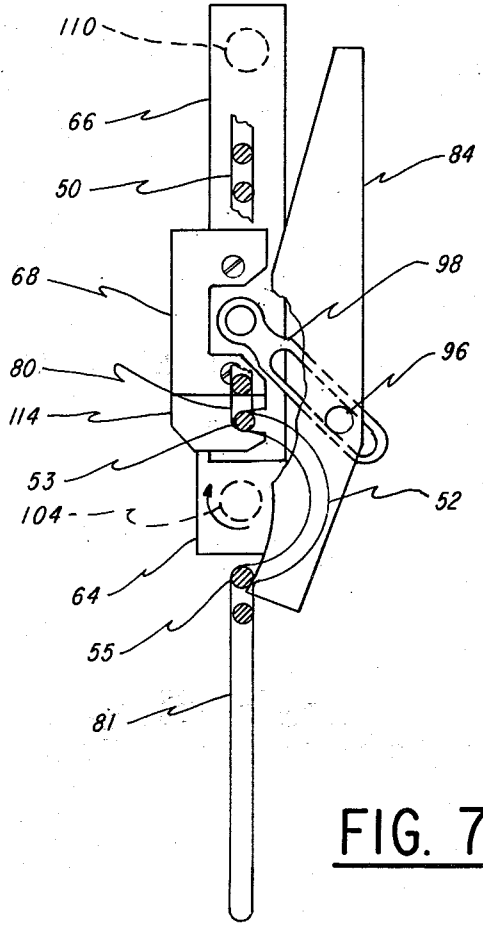

FIG. 7A, B, C and D are simplified, schematic views of the mechanisms shown in FIGS. 4, 5 and 6 showing a tray being moved, together with the stack of trays, downwardly through the region of the path of the trays where the sheets are received, each view being at a different position during a cycle of operation of the mechanism so as to illustrate the operation thereof.

DETAILED DESCRIPTION

Figure 1:
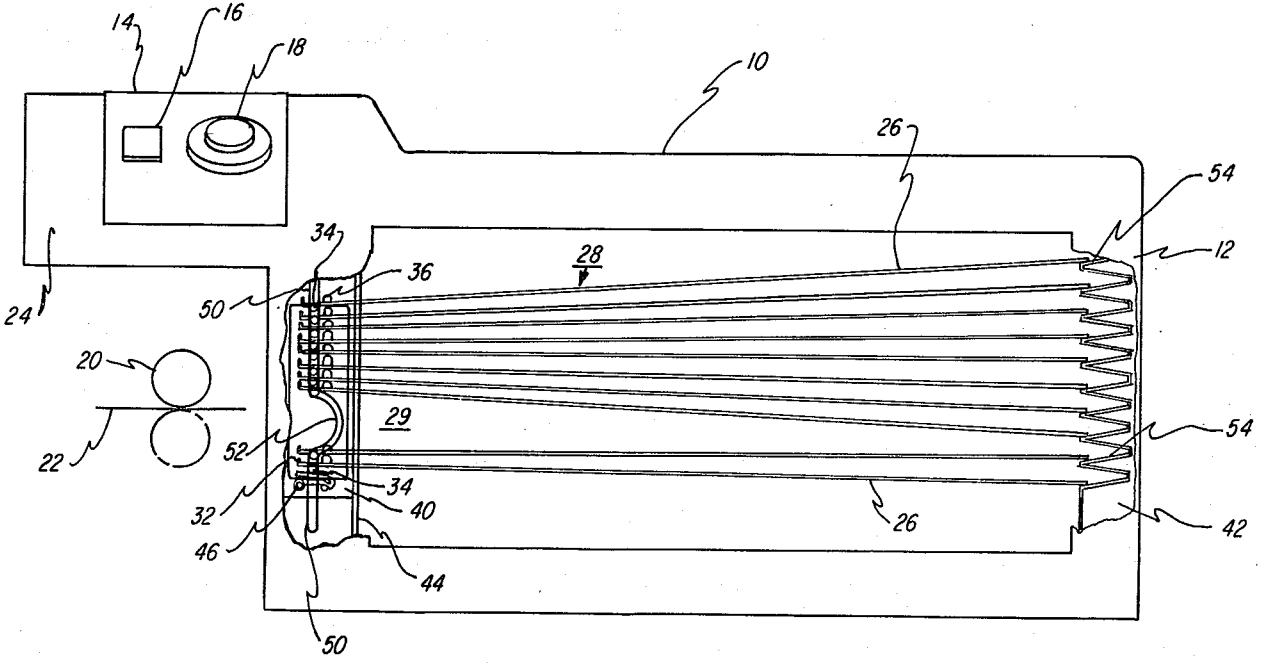
FIG. 1 is a simplified side view of sorting apparatus embodying the invention with the enclosure thereof partially broken away so as to schematically illustrate the stack of trays and part of the mechanism associated therewith.
Figure 2:
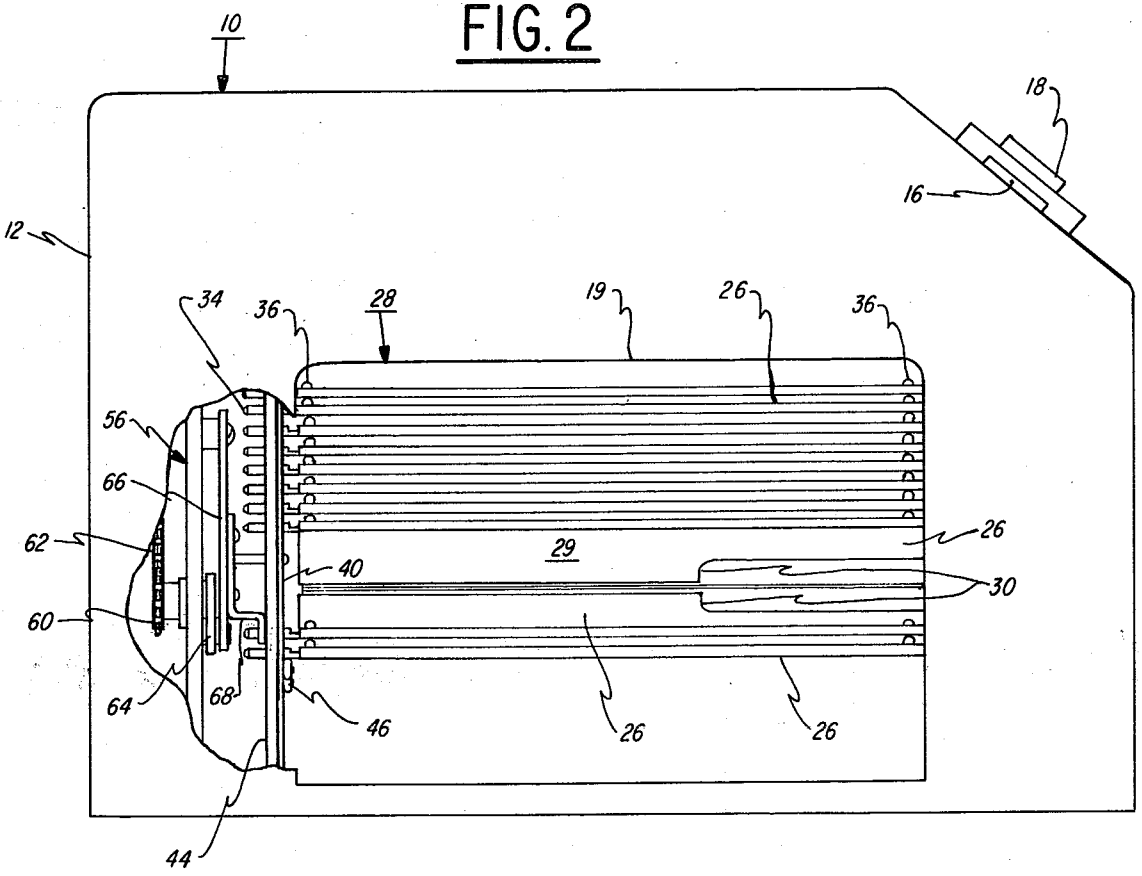
FIG. 2 is a front end view of the apparatus shown in FIG. 1 with the enclosure thereof also shown partially broken away to illustrate the stack of trays and the mechanism associated therewith.
Figure 3:
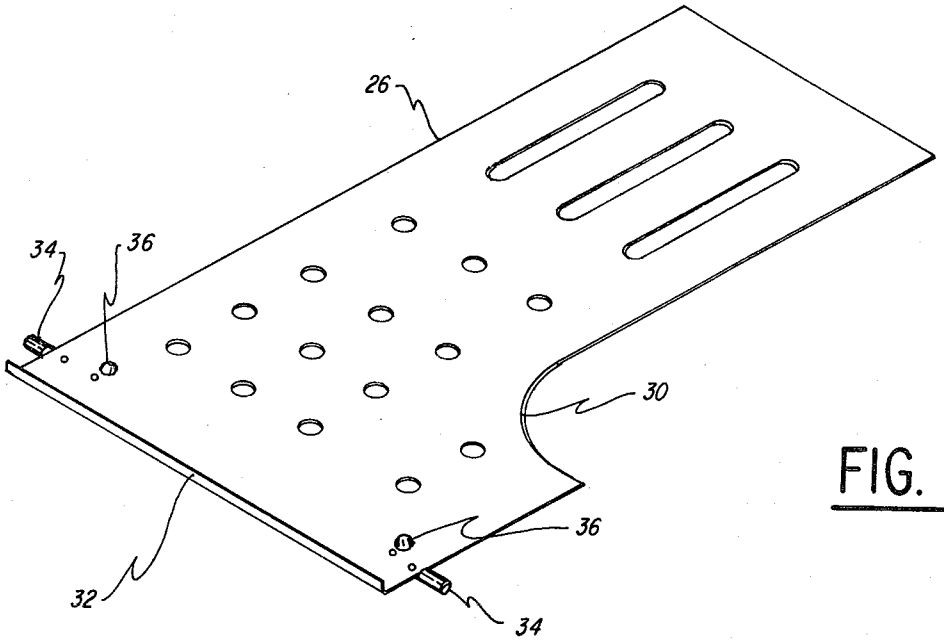
FIG. 3 is a perspective view of one of the trays which is used in the sorter apparatus shown in FIGS. 1 and 2.

Referring more particularly to FIGS. 1, 2 and 3 of the drawings, there is shown a sorter apparatus 10 having an enclosure 12. Controls 14 are mounted on the enclosure 12 and may include a start button 16 and a dial 18 which sets the number of sheets of duplicate copies which are to be distributed and collated by the sorter 10. Microprocessor controls may also be used.

A pair of feed rolls 20 at the front end of the sorter 10 is schematically shown to illustrate the output sheet feeder of desk top type xerographic copier with which the sorter 10 is used. Sheets, a portion of one of which is illustrated by the line 22, are fed into and received by the sorter at the front or forward end thereof. The control and part of the motor and other drive parts of the sorter 10 may be located in a cantilevered section 24 of the sorter which serves to locate the input or front end of the sorter with the rear or output end of the copier.

The sheets are distributed onto different ones of a plurality of trays 26 in a stack of trays 28. The trays are all alike. A typical tray is shown in FIG. 3. The tray 26 is generally rectangular and has a scooped out section 30 to enable the set of sheets which are received on the tray to be removed. The holes and slots in the tray serve to lighten the weight and to eliminate or reduce air turbulence. The front end of the tray is provided with a lip 32 to prevent the sheets from slipping out of the tray. Pins 34 are attached to the tray near the front end thereof and project laterally from the opposite edges of the tray. These pins are the tray portions which are engaged in order to translate the trays and lift and lower them together with the stack 28 during the operation of the sorter 10. Projections, which are illustrated as buttons 36, are located on the upper side of each tray near the location of the pins 34. These buttons may be of nylon or Teflon, since the undersides of the trays bear and slide slightly thereon. Tabs may be used instead of the buttons 36.

An opening 19 in the front end of the enclosure 12 is shown in FIG. 2. The front ends of the trays 26 appear in the opening 19. A region 29 in the stack 28 of trays is exposed by the opening. This is the region 29 where adjacent trays are spread apart to receive the sheets, as ejected by the output feed rollers 20 of the copier, with sufficient force to travel to and fall on the tray at the bottom of the region 29.

The stack 28 of trays 26 is retained in the enclosure at the front and rear end thereof by movable and particularly vertically slidable retaining members or carriages 40 at the front end and a rack 42 at the rear end of the trays. The retaining members or carriages 40 are slidably disposed in vertical guide members 44 located near the front of the enclosure along the edges of the trays. One of these guide members 44 is shown in FIGS. 1 and 2. The retaining member 40 may be identified in FIGS. 1 and 2 by a hairpin spring 46 disposed on the underside of a generally rectangular opening 48 (see FIG. 5) in the generally rectangular retaining member 40. The pins of the upper-most tray 26 in the stack 28 are located in engagement with the upper edge of the opening 48, while the pins 34 on the lower most of the trays in the stack 28 are in engagement with the spring 46 adjacent the lower edge of the opening 48 in the retaining member 40.

The guide members 44 have slots 50 which define a path for the generally vertical movement, upwardly and downwardly, of the stack 28 of trays. This path and the slot 50 has a region 52 in which the trays are spread apart to define the sheet receiving region 29.

The rack 42 at the rear end of the stack 28 of trays has shelves 54 which are inclined upwardly and upon which the underside of each tray at the rear end thereof is loosely seated. As the trays are moved with the retaining members 40 at the front end thereof, the rear ends of the trays pivot and translate longitudinally on the shelves 54. The translational movement of the tray which is carried around the region 52 of the slot is greater than the translational movement of the other trays. The arrangement of shelves facilitates such translational and pivotal movement.

A mechanism 56 for raising and lower the trays is provided adjacent each of the guide members 44. In other words, the arrangement of the guide members 44, the retainer member 40 and the mechanism 56 as shown on the left in FIG. 2 has its mirror image on the right, along the right edge of the trays 26. Ten trays 26 are shown, by way of example, in the stack. The illustrated sorter 10 is, therefore, capable sorting ten duplicate copies of each original sheet as it is successively duplicated by the copier associated with the sorter 10. Ten sets of copies can therefore be distributed or collated on the trays 26. Fewer trays or somewhat more trays may be provided; in the latter case, by increasing the height of the sorter 10. Stops (not shown) are provided for the upper and lower ends of the retainer or carriage 40 to limit the movement of the stack in the upward and downward direction.

In operation, each time a sheet is received in the sorter, that event is sensed; for example, photo electrically, and the mechanism 56 for translating the trays is operated to execute one complete cycle. If sets of ten copies are to be sorted, the trays are moved first in one direction, for example upwardly from a location where the uppermost tray is at the lower end of the region 52 of the slot 50. After ten cycles and ten sheets have been sorted on each of the ten trays, the trays are translated downwardly and ten copies of the next sheet are sorted onto the ten trays. The process continues with upward and downward movements of the trays until the ten complete sets are sorted. If fewer than ten sheets are in a set, only the number of trays, either at the top of the bottom of the stack 28 which are needed are used. These trays, together with the stack, are then moved up and down until the required number of sets are sorted. The control 18 provides for the reversal of direction of movement of the sets after the requisite number of copies of each sheet are received.

In moving the trays, the mechanism 56 utilizes sprockets 60 which may be driven by chains 62 from a common drive shaft. A single, reversible motor in the enclosure 12 above the stack 28 of trays turns the drive shaft. Cranks 64 are driven by the sprockets and rotate and translate beams 66 which carry latch members 68. Hooks at the ends of the latch members 68 engage the pins 34 at the edges of the trays to be raised or lowered around the region 52. The hooks orbit in circles around the slot regions 52. The pins 34 are then carried from one end to the opposite end of the curved, semicircular slot regions 52. The orbit of the hooks is completed as they leave the pins. The hooks then are brought into position to engage the pins on the next adjacent tray. The operation of the mechanism 56 will be discussed in greater detail in connection with FIG. 7A-D.

Referring more particularly to FIGS. 4, 5 and 6, the guide member 44 is shown as a bar 70 on which a pair of stepped rectangular rods 72 define a channel 74 in which the retainer member 40 is slidably mounted. The retainer member or carriage 40 is a generally rectangular plate with the generally rectangular opening 48 therein. Inasmuch as the pins 34 of all of the trays 26 in the stack 28 are disposed in the opening 48 between the upper and lower edges thereof, the stack of trays moves the retainer member when any of the trays is itself moved. Accordingly, the pins 34 are positively translated and registered in locations defined by steps in the guide member 44 at the opposite ends 53 and 55 of the semicircular region 52 of the slot 50. The pins can therefore be engaged by the tray translating mechanism 56. The hairpin spring 46 engages the pin of the bottom tray in the stack. The use of a spring 46 is preferred in that it accommodates tolerances or differences in dimensions of the trays 26, the pins 34, and the buttons 36 so that all of them can fit in the hole 48 in the carriage or retainer member 40.

The guide member 44 contains the slot 50 and the straight or linear upper and lower portions 80 and 81 thereof which are above and below and define regions above and below the semicircular region 52 thereof. The semicircular region 52 defines the sheet receiving region 29 in the stack of the trays where they are spread apart. The guide member 44 also serves as a mounting for a beam 84. The beam 84 is connected to a pin 86 which is journalled in the guide member 44. A hairpin spring 88, which engages a finger 90 at the upper end of the beam 84, biases a circularly curved edge 92 of the beam against the pins 34 which are disposed in the upper and lower ends 53 and 55 of the semi-circular slot 52. The beam 84 therefore serves as a pusher and insures that the pins 34 are located at the steps at the ends 53 and 55 of the curved region of the path of the trays where they are spread apart to receive the sheets.

The pusher beam 84 also has a pin 96 which is attached thereto and has an enlarged head which maintains it in the slot of a slotted line 98. The link 98 is part of a lost motion mechanism. It is pivotally mounted by a pivot pin 100 on the beam 66 of the translating mechanism 56. The link 98 serves to impart an intermittent force to the pusher beam 84. The rotational movement of the translating mechanism 56 is translated, during a portion of the cycle of rotation of the crank 64 thereof, into rotation of the beam 84 in the same direction as the direction in which the beam is biased to rotate by the hairpin spring 88. The link 98 causes the beam 84 to impart a pushing force against the pin 34 as it reaches the end of the curved region 52 as it travels between the opposite ends 53 and 55 thereof. This pushing action further assists in carrying the tray to the end of its travel at the opposite end of the region 52. Although the use of the pusher beam 84 is preferred in order to guarantee reliable and positive movement of the trays, the use thereof is optional, as the primary drive and location of the trays at the opposite ends of the region 52 is accomplished by means of the retainer or carriage member 40.

The translating mechanism 56 is mounted on a strut 102, which may be part of the main frame of the sorter. The sprocket 60 is journalled in the strut 62. A sprocket drive such as includes the sprocket 60 is preferred. Belts or gear drives may be used, if desired. The crank 62 is carried on a shaft 104 which is rotated by the sprocket 60. The crank has a boss 106 which rides in a circular slot 108 for stablization purposes. The beam 66 is pivotally mounted at the lower end thereof on the crank 64. A rod 110, attached to the upper end of the beam 66, passes through a slot 112 in the strut 102 and guides the beam 66 so that it may translate while being rotated by the crank 64. The latch member 68 is riveted to the beam 66. An off set hook portion 114 of the latch member 68 engages or latches with the pin 34 at one of the opposite ends 53 and 55 of the semicircular region 52 of the slot 50. The latch member 68 may be an integral part of the beam to further simplify the construction.

FIGS. 7A–D shows the exemplary case when the trays are translated downwardly through the sheet receiving region 29. Then the crank 64 and the crank shaft 104 rotate in a clockwise direction as viewed in FIGS. 7A–B and also in FIG. 5. When the trays are to be translated upwardly, the crank and crank shaft will rotate in a counter clockwise direction.

Starting with the crank 64 in the twelve o'clock position as shown on FIG. 7A, the hook 114 in the lower end of the latch member 68 engages the pin of the tray which is located in the upper end 53 of the semicircular slot region 52. Continued clockwise rotation of the crank 64 causes the lower end of the latch member 68 and the hook 114 to orbit circularly and carry the pin which was in the upper end 53 around the slot. FIG. 7B shows the crank in approximately the three o'clock position. The translational movement in the downward direction, of the tray which is being carried by the hook 114 of the latch 68, is transferred by the engagement on the underside of the tray 26 being moved with the button 36 of the tray below it in the straight slot portion 81. That tray is therefore translated downwardly along the lower straight portion 81 of the slot 50. The next tray, which in the illustration of FIG. 7B is the last or lowermost tray receives the motion of the tray above it, and is forced downwardly. The pin 34 on the lowermost tray 26 engages the spring 46 (FIG. 5) which in turns transfers the downward motion to the carriage 40. The upper edge of the opening 48 in the retainer 40 moves downwardly and positively urges the pins and the trays guided in the upper straight portion 80 of the slot 50 downwardly to seat the pin of the tray which is next above the tray which is being moved through the slot portion 52 in the upper end 53 thereof.

Just before the pin which is moved (the pin of the third tray from the bottom of the stack) reaches the lower end 55 of the slot region 52, the end of the slot in the slotted link 98 engages the pin 96 of the pusher beam 84 and causes the beam to pivot in a clockwise direction as shown in FIGS. 7B and C to assist in carrying the pin to the lower end 55 of the region 52. In FIG. 7C the crank 64 is in the six o'clock position and the beam 66 together with the latch 68 translate downwardly, the translation being guided by the slot 112 which engages the shaft 110 at the upper end of the beam 66.

Figure 7D:
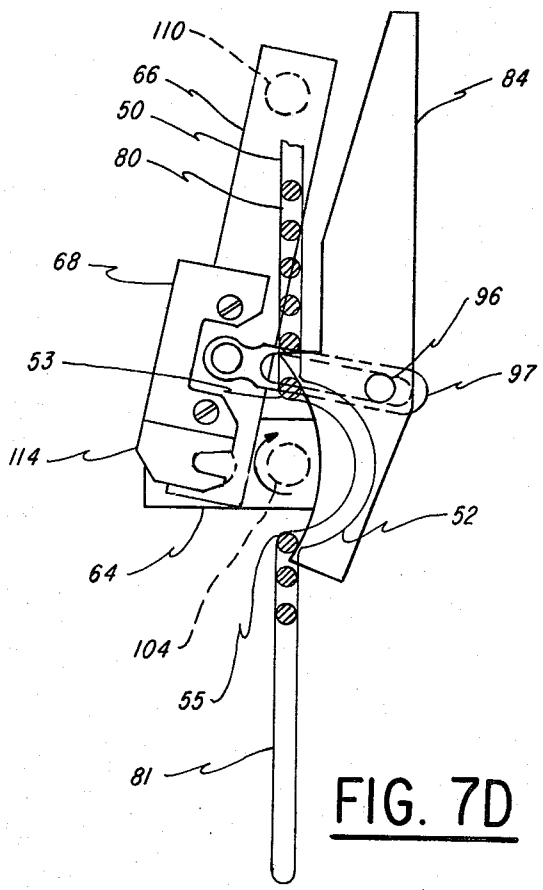
Figure 7C:
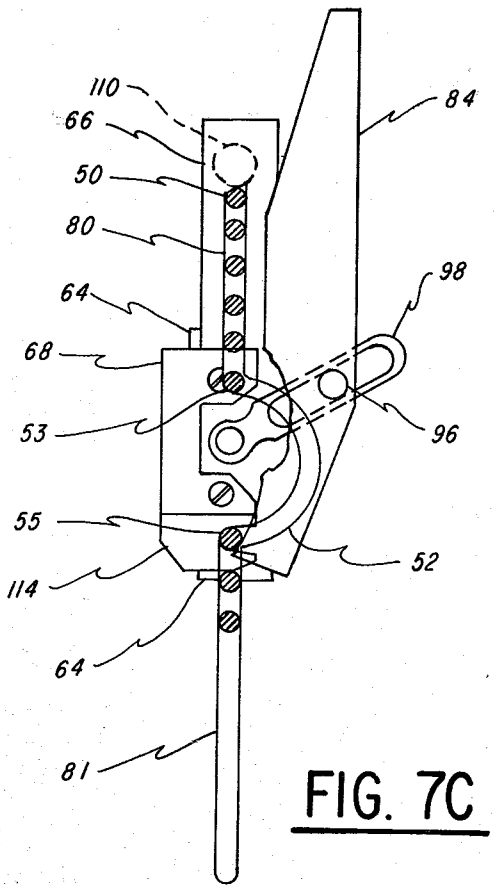

As shown in FIG. 7D, where the crank 64 is at the nine o'clock position, the lower hook end 114 of the latch 68 continues its orbit as it moves free of the pin toward the position shown in FIG. 7A. Another cycle of orbital movement may follow to bring the next tray in the stack down to the bottom of the semicircular slot region 52. The tray whose pins are located at the bottom end 55 of the circular region 52 of the slot 50 is in the position to receive the sheets as they are fed out of the copier. It will also be observed from FIG. 7D that when the crank is moving in the counter clockwise direction to lift the trays, the slot in the link 98, at approximately the 135° position of its rotation, will engage the pin 96 and urge the pusher beam 84 to the left to assist the location of the pin which is being moved into the end of the slot to which it is traveling.

While a presently preferred embodiment of sorter apparatus in accordance with the invention and the best known mode of operation thereof has been described, it will be appreciated that variations and modifications of the herein described apparatus and of its operation, within scope of the invention, will undoubtedly suggest themselves to those skilled in the art. Accordingly, the foregoing description should be taken as illustrative and not in a limiting sense.

I claim:

1. Sheet sorting apparatus which comprises a plurality of sheet receiving trays disposed in a stack, said trays having forward sheet receiving ends and rear ends opposite to said forward ends, means retaining said trays in stacked relationship and moveable therewith, means defining a path along which said trays and retaining means are movable, said path including first, second and third regions, said third region defining steps with said first and second regions at the opposite ends of said third region where adjacent ones of said trays are spaced apart to receive said sheets, said retaining means being a carriage having an opening equal in length to the height of said stack at the forward ends of said trays, said trays being disposed in said opening, and means engageable with the tray at the step at one end of said third region or with the tray at the step at the opposite end of said third region to carry the engaged tray between the ends of said third region to move said stack with said retaining means carriage along said path.

2. The invention as set forth in claim 1 wherein said path is defined by guide means which are disposed adjacent the forward ends of said trays into which said sheets are received.

3. The invention as set forth in claim 2 wherein said guide means includes a member disposed adjacent an edge of said trays, a slot in said member which defines said path, a member projecting from said edge of each of said trays into said slot, said slot having straight portions providing said first and second regions at the opposite ends of said third region to define said steps in which said projecting members of adjacent ones of said trays are disposed.

4. The invention as set forth in claim 3 wherein said slot in said third region is curved so as to separate said trays at the opposite ends of said third region by a distance sufficient to allow said sheets to enter between said spread apart trays.

5. The invention as set forth in claim 3 further comprising a pivotally mounted member moveable transversely of said slot and engaging said projecting members in said opposite ends of said third region for biasing said projecting members into said opposite ends of said third region and holding said projecting members on said steps.

6. The invention as set forth in claim 4 wherein said curve is a semicircle of diameter equal to said distance.

7. The invention as set forth in claim 1 wherein said carriage for said stack of trays is disposed near the forward end of said trays, and means mounting to the rear ends of said trays for enabling movement of said rear ends as said trays move along said path and through said third region.

8. The invention as set forth in claim 7 wherein said trays are generally rectangular in shape and said mounting means for said rear ends of said trays provide for movement at said rear ends of each tray both pivotally and longitudinally.

9. The invention as set forth in claim 8 wherein said mounting means comprises a rack having a plurality of vertically spaced shelves each tilted upwardly from the front towards the back thereof, said rear ends each being disposed on a different one of said shelves for free, pivotal sliding movement thereon.

10. The invention as set forth in claim 1 wherein each of said trays in said stack has opposite sides which face in opposite directions and at least one of which sides faces a side of an adjacent tray in said stack, projections extending in the same direction from one side of each of said trays near the end thereof which receives said sheets to maintain said trays in spaced relationship in said stack and to engage the opposite sides of said trays for transferring motive forces therebetween.

11. The invention as set forth in claim 10 wherein said trays are in vertically stacked relationship, said one side being the top side of said trays, and said projections being attached to said top sides and extending vertically into engagement with the bottom sides of adjacent ones of said trays.

12. The invention as set forth in claim 2 wherein said guide means comprises a vertical guide member disposed adjacent to an edge of said trays at the forward ends thereof, said guide member having a slot which defines said path with said first and second regions being defined by vertical portions above and below said third region, pins attached to each of said trays extending laterally into said slot, and said retaining means carriage being slidably disposed in said guide member, said carriage opening engaging the pins projecting from the uppermost and lowermost trays to retain said trays in stacked relationship while said stack of trays moves vertically along said path.

13. The invention as set forth in claim 12 wherein said trays have pins extending laterally therefrom near the forward ends thereof, said means engageable with said trays comprises a member having a portion moveable in an orbital path in a plane about the center of third region into engagement with said pins of the tray at one of said opposite ends of said third region to carry said last named tray to the other of said opposite ends of said region and apply translational forces to said tray through said carriage to move said stack and locate the pins of said tray next adjacent said last named tray at said one of said opposite ends at the step thereat.

14. The invention as set forth in claim 13 wherein said orbitally moveable member portion has a notch defining a hook in which said pin is engaged during orbital movement of said portion around said region.

15. The invention as set forth in claim 13 further comprising a link movable toward and away from said pins at the opposite ends of said region biasing said last named pins into said opposite ends.

16. The invention as set forth in claim 13 wherein said orbitally movable member is a beam rotationally and translationally movable along said path, and a crank connected to said beam to move said member orbitally along said third region.

17. The invention as set forth in claim 16 wherein said crank is rotatable one revolution for each sheet which is received by said apparatus.

18. The invention as set forth in claim 17 wherein means are provided for rotating said crank in one direction a plurality of times equal in number to the number of said trays and then in the opposite direction said plurality of time equal in number to said number of trays to move said stack upwardly and downwardly while bringing each of said trays successively in sheet receiving position in said third region.

19. The invention as set forth in claim 16 further comprising a pusher beam pivotally mounted on said guide member for movement forward and away from said pins at the end of said third region, a lost motion linkage pivotally connected to said beam to which said crank is connected and coupled to said pusher beam for pivoting said pusher beam into engagement with said pin which is carried around said third region from said one to said opposite end thereof to assist in bringing said carried pin to the opposite end of said third region.

20. The invention as set forth in claim 19 further comprising a spring engaging said pusher beam and said guide member to bias said pusher beam continuously toward said pins in said third region and at the opposite ends thereof.

* * * * *